US009038526B2

(12) United States Patent
Liu et al.

(10) Patent No.: US 9,038,526 B2
(45) Date of Patent: May 26, 2015

(54) KINEMATIC CONTROL IN A HYDRAULIC SYSTEM

(75) Inventors: Mingyu Liu, Bolton (CA); William Harold Howlett, Etobicoke (CA); Daoshan Ouyang, Bolton (CA)

(73) Assignee: HUSKY INJECTION MOLDING SYSTEMS LTD., Bolton, Ontario (CA)

( * ) Notice: Subject to any disclaimer, the term of this patent is extended or adjusted under 35 U.S.C. 154(b) by 827 days.

(21) Appl. No.: 13/321,225

(22) PCT Filed: May 28, 2010

(86) PCT No.: PCT/CA2010/000777
§ 371 (c)(1),
(2), (4) Date: Nov. 18, 2011

(87) PCT Pub. No.: WO2010/144993
PCT Pub. Date: Dec. 23, 2010

(65) Prior Publication Data

US 2012/0090310 A1 Apr. 19, 2012

Related U.S. Application Data

(60) Provisional application No. 61/218,572, filed on Jun. 19, 2009.

(51) Int. Cl.
*F15B 11/042* (2006.01)

(52) U.S. Cl.
CPC ..... *F15B 11/0423* (2013.01); *F15B 2211/755* (2013.01)

(58) Field of Classification Search
CPC ..... F15B 11/0423; F15B 2211/56; F15B 11/042; F15B 15/22; F15B 2211/755
USPC ..... 60/431, 461, 368; 91/400
See application file for complete search history.

(56) References Cited

U.S. PATENT DOCUMENTS

| | | | | |
|---|---|---|---|---|
| 3,713,291 | A | 1/1973 | Kubik | |
| 4,563,939 | A | 1/1986 | Siegrist | |
| 4,565,116 | A | 1/1986 | Hehl | |
| 5,093,052 | A * | 3/1992 | Wurl et al. | 264/40.1 |

(Continued)

OTHER PUBLICATIONS

Neubert T: "Drehzalverraenderbarer verstellpumpenantrieb in kunststoff-spritzgiessmaschinen", O+P Olhydraulik und pneumatik, vereinigte fachverkage, Maint, Germany, vol. 45, No. 10, Oct. 1, 2001, pp. 654-659.

(Continued)

*Primary Examiner* — Nathaniel Wiehe
*Assistant Examiner* — Abiy Teka

(57) ABSTRACT

A hydraulic system is provided, having a pump, operably connected to a motor. It also comprises a controller-driven hydraulic actuator, operably connected to the pump and a hydraulic valve, operable to direct hydraulic fluid to and from either a rod side or a cylinder side of the hydraulic actuator. Rod and cylinder side pressures are pre-defined based on the instantaneous acceleration or deceleration required. Decelerating the hydraulic actuator could involve maintaining the current pressure in the meter-out side of the hydraulic actuator and decreasing the current pressure in the meter-in side by varying the speed of the pump. Deceleration of the hydraulic actuator could also include decreasing pressure on the meter-in side of the hydraulic actuator at a higher rate than on the meter-out side. Acceleration is achieved using a similar approach.

20 Claims, 3 Drawing Sheets

(56) References Cited

U.S. PATENT DOCUMENTS

| | | | | |
|---|---|---|---|---|
| 5,238,383 | A | 8/1993 | Bannai | |
| 6,179,600 | B1 | 1/2001 | Siegrist et al. | |
| 6,289,259 | B1 | 9/2001 | Choi et al. | |
| 6,868,305 | B2 | 3/2005 | Choi et al. | |
| 7,387,061 | B2 * | 6/2008 | Kobata et al. | 91/405 |
| 2007/0182044 | A1 | 8/2007 | Grimm | |
| 2008/0089964 | A1 | 4/2008 | Kianpour et al. | |
| 2008/0228323 | A1 * | 9/2008 | Laumer et al. | 700/285 |

OTHER PUBLICATIONS

PCT International Search Report, Stephane Ouellete, Jul. 16, 2010, 4 pages.

* cited by examiner

KINEMATIC CONTROL IN A HYDRAULIC SYSTEM

FIELD OF THE INVENTION

The present invention relates to hydraulics. More specifically, the present invention relates to hydraulic actuators used in injection molding machines.

BACKGROUND OF THE INVENTION

Examples of known molding systems are (amongst others): (i) the HyPET™ Molding System, (ii) the Quadloc™ Molding System, (iii) the Hylectric™ Molding System, and (iv) the HyMet™ Molding System, all manufactured by Husky Injection Molding Systems Limited (Location: Bolton, Ontario, Canada; www.husky.ca). Molding systems, such as the ones listed above typically use hydraulic systems to power various subsystems, such as stroke and clamp actuators, and injection screws and pistons. A pump drives hydraulic fluid through the system.

FIG. 1 is a simplified plan view of a generic molding system 20 (for example, an injection molding system hereafter referred to as the "system 20"). The system 20 is used to mold one or more molded articles (not shown). The system 20 includes components that are known to persons skilled in the art and these known components will not be described here; these known components are described, by way of example, in the following references: (i) Injection Molding Handbook by Osswald/Turng/Gramann ISBN: 3-446-21669-2; publisher: Hanser, and (ii) Injection Molding Handbook by Rosato and Rosato ISBN: 0-412-99381-3; publisher: Chapman & Hill. The system 20 includes (amongst other things): an injection-type extruder 22 (hereafter referred to as the "extruder 22") and a clamping assembly 23.

The extruder 22 includes a hopper 24, a human-machine interface, hereafter referred to as the "HMI 28". The extruder 22 has a barrel and a reciprocating screw 26 disposed in the barrel. Alternatively, the extruder 22 could be a two stage shooting pot configuration. The hopper 24 is coupled to a feed throat of the extruder 22 so as to deliver pellets of moldable material to the extruder 22. The extruder 22 is configured to: (i) process the pellets into an injectable molding material, and (ii) inject the injectable material into a mold that is held closed by the platens 30, 32 after the platens 30, 32 have been stroked together. The HMI 28 is coupled to the control equipment, and the HMI 28 is used to assist an operator in monitoring and controlling operations of the system 20.

The clamping assembly 23 includes a stationary platen 30, and a moveable platen 32. Referring now to FIG. 2, a clamping assembly 23 manufactured by the applicant is shown in greater detail. The stationary platen 30 is configured to support a stationary mold portion 31*a* of a mold 31. The moveable platen 32 is configured to: (i) support a moveable mold portion 31*b* of the mold 31, and (ii) move relative to the stationary platen 30 so that the mold portions of the mold 31 may be separated from each other or closed together. A mold stroke actuator 36 (hereafter referred to as the "actuator 36") is coupled to the movable platen 32 and a clamp platen 35. The mold stroke actuator 36 is used to stroke the moveable platen 32 relative to the stationary platen 30. In the presently-illustrated embodiment, the actuator 36 is a hydraulic piston. Typically, during mold closure, the actuator 36 decelerates shortly before achieving contact between the two mold halves to reduce the impact and preserve the lifespan of the mold. The clamp platen 35 further supports a clamp actuator 38 coaxially located around the mold stroke actuator 36. Four tie bars 40 each extend between clamp platen 35 and stationary platen 30.

Movement of movable platen 32 is regulated by a predetermined desired velocity profile, which is generated based on operator inputs of acceleration, maximum speed, deceleration and stroke distance through HMI 28, or alternatively, is provided by a lookup table. For every moment of the actuator stroke cycle, a closing velocity setpoint is provided for movable platen 32. Thus, at T=0 the velocity setpoint starts at zero. The velocity setpoint reaches the peak and then begins decelerating to avoid the mold halves from crashing together. Open or closed loop control is used to regulate the actual acceleration and deceleration, based on either time or position.

U.S. Pat. No. 5,238,383 to Bannai teaches a mold opening controller for injection molding machines, having a control unit for controlling the hydraulic circuit. The control unit having a setter for setting acceleration/deceleration functions of a movable portion such as the movable mold; a data input for the setter; an operational unit for calculating the acceleration/deceleration of portions of the movable mold and the acceleration/deceleration speeds at each moving position at the time of the acceleration/deceleration on the bases of data from the setter and the data input; a position sensor for detecting the moving position of the movable mold; and a control for controlling the hydraulic circuit so that acceleration/deceleration positions of the movable mold and its moving speed at each position correspond to the output values of the operational unit through the position sensor.

US patent application 2007/0182044A1 to Grimm teaches a method for operating an injection molding machine, particularly a method for securing tools of an injection molding machine, a desired variable curve is determined along at least one section of a travel path of a molding tool in a desired variable determination phase, and the injection molding machine is operated according to the determined desired variable curve in a subsequent operational phase. A default curve of at least one initial variable is predefined, the molding tool is driven in accordance with the default curve of the initial variable in a test run, at least one resulting value of the desired variable is measured and stored during the test run, and a desired variable curve is formed along the section of the travel path from the measured values of the desired variable.

SUMMARY OF THE INVENTION

According to a an aspect of the invention, there is provided a method for decelerating a hydraulic actuator. The method includes performing one of maintaining pressure and decreasing the pressure in a meter-out side of the hydraulic actuator. The method also includes decreasing pressure on a meter-in side of the hydraulic actuator, the hydraulic actuator decreasing pressure on the meter-in side more rapidly than on the meter-out side of the hydraulic actuator. Decreasing pressure on the meter-in side of the hydraulic actuator is achieved by adjusting a speed in a pump.

According to a first another of the invention, there is provided a method for accelerating a hydraulic actuator. The method includes performing one of maintaining pressure and increasing the pressure in a meter-out side of the hydraulic actuator. The method also includes increasing pressure on a meter-in side of the hydraulic actuator, the hydraulic actuator increasing pressure on the meter-in side more rapidly than on the meter-out side of the hydraulic actuator. Increasing pressure on the meter-in side of the hydraulic actuator is achieved by adjusting a speed in a pump.

According to another aspect of the invention, there is provided a hydraulic system. The hydraulic system includes a pump, operably connected to a motor; a hydraulic actuator, operably connected to the pump; a hydraulic valve, operable to direct hydraulic fluid to and from either a rod side or a cylinder side of the hydraulic actuator; and a controller. The controller is configured to alternatively accelerate and decelerate the hydraulic actuator by performing one of maintaining a current pressure and adjusting the pressure in a meter-out side of the hydraulic actuator. The controller is also configured to adjust pressure on a meter-in side of the hydraulic actuator at a higher rate than on the meter-out side of the hydraulic actuator. Adjusting the pressure on the meter-in side of the hydraulic actuator is achieved by adjusting a speed in the pump.

DETAILED DESCRIPTION OF THE DRAWINGS

The non-limiting embodiments of the present invention are disclosed in the following description and in the accompanying drawings, wherein.

DETAILED DESCRIPTION OF THE NON-LIMITING EMBODIMENTS

Figure 1:
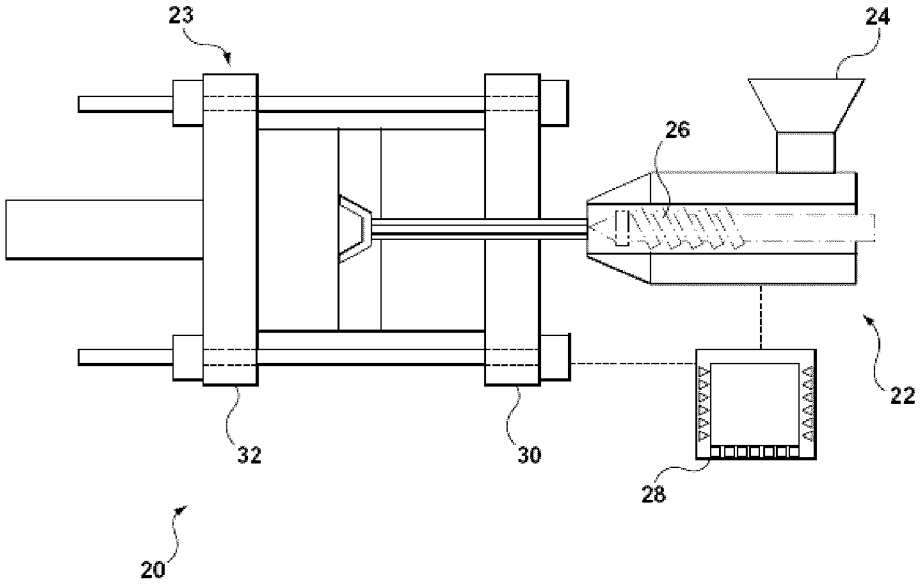
FIG. 1 (PRIOR ART)
FIG. 1 is a simplified side-plan view of a prior art molding machine.
Figure 2:
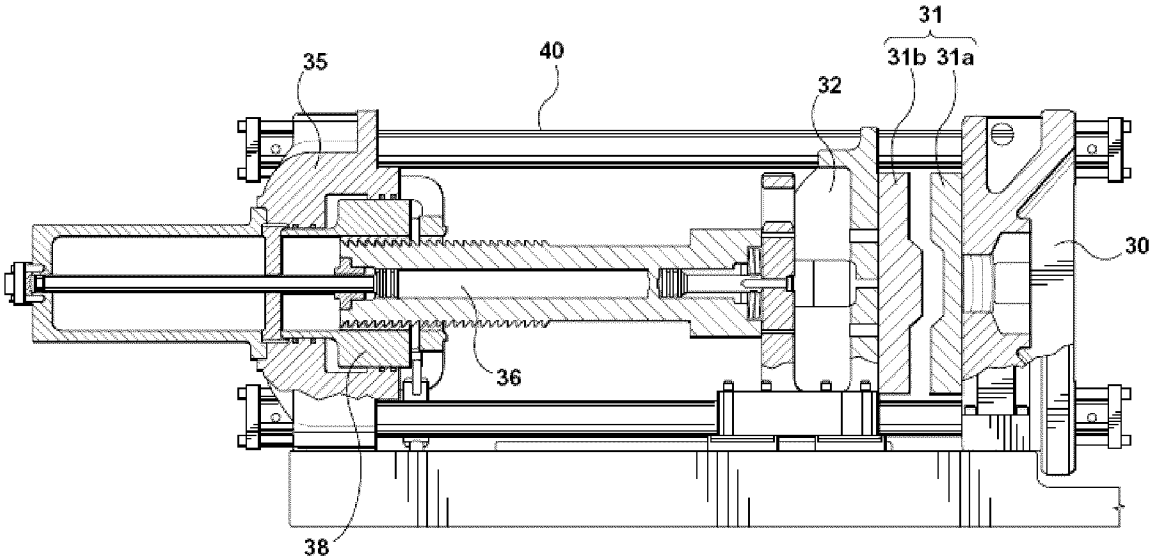
FIG. 2 (PRIOR ART)
FIG. 2 is a cross-sectional view of a clamping assembly for the prior art molding machine of FIG. 1.
Figure 3:
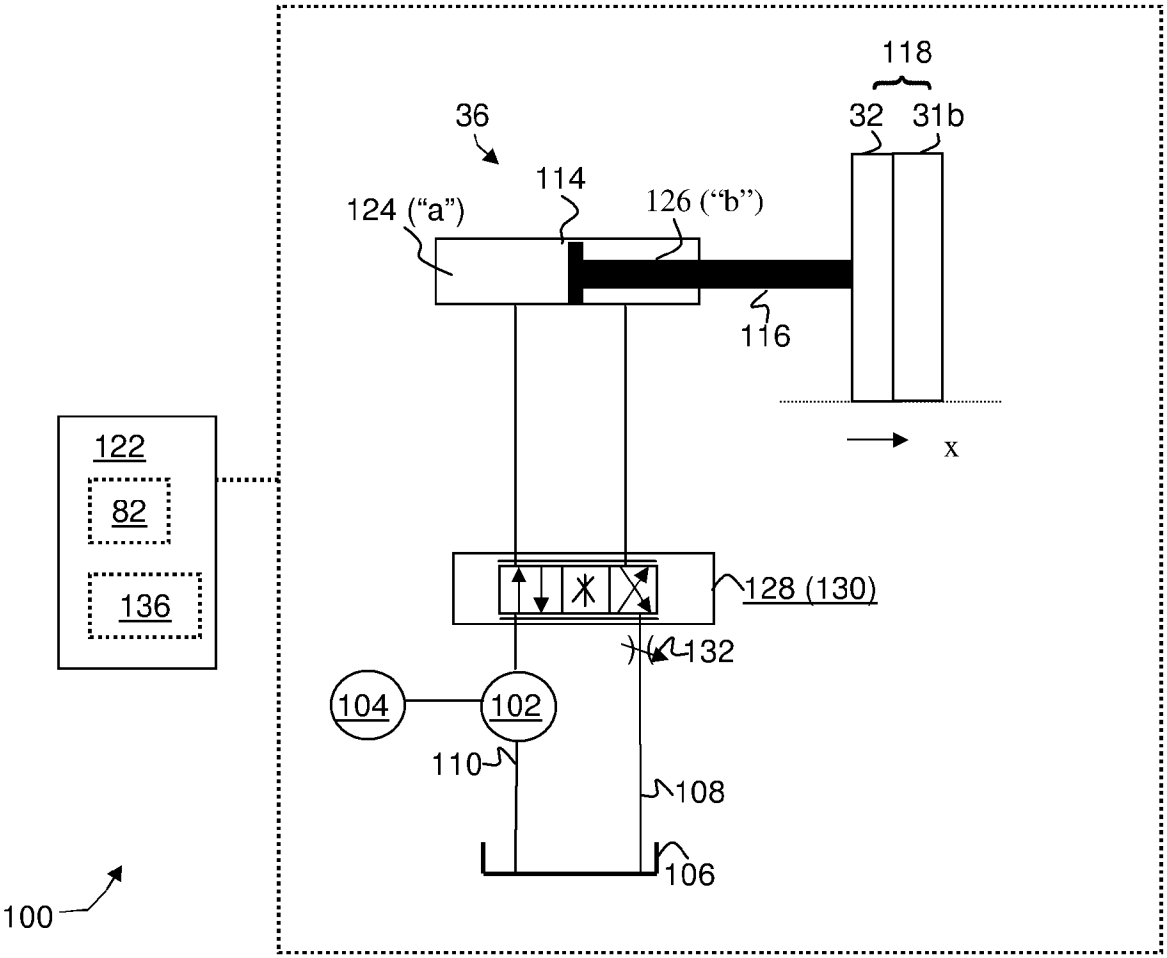
FIG. 3 depicts a schematic diagram of a hydraulic system according to a non-limiting embodiment of the present invention.

Referring now to FIG. 3, a schematic for a hydraulic system operable to drive actuator 36 is shown generally at 100. Hydraulic system 100 includes a pump 102, a motor 104 operably connected to pump 102, and a reservoir 106 operable to supply the pump 102 with hydraulic fluid. The pump 102 is not particularly limited and can include both fixed and variable displacement pumps, as is known to those of skill in the art. In the presently-illustrated embodiment, pump 102 is a servo-driven pump. Hydraulic fluid (typically hydraulic oil) is fed to pump 102 by a supply line 110, and is returned to reservoir 106 by a return line (or lines) 108. Hydraulic fluid motivated by pump 102 is used to power at least one hydraulic actuator, which in the presently illustrated embodiment is mold stroke actuator 36. Mold stroke actuator 36 includes a cylinder 114, and a piston 116 which is connected to a load mass 118 (typically a movable platen 32 and a mold portion 31*b*). A controller 122, operably connected to HMI 28 (FIG. 1), is provided to regulate the operations of pump 102, motor 104 and other systems as will later be described.

The piston 116 divides mold stroke actuator 36 into a "cylinder" side 124 and a "rod" side 126 as is known to those of skill in the art (alternatively, referred to as side 'a' or side 'b', respectively). Actuation of the mold stroke actuator 36 occurs by pressurizing either cylinder side 124 or rod side 126. While extending piston 116, pressure is directed to cylinder side 124, which can alternatively be referred to as the "meter-in" side. The rod side 126 is concurrently depressurized, and is also referred to as the "meter-out" side. While retracting piston 116, rod side 126 becomes the meter-in side, and cylinder side 124 is the meter out-side. However, in an injection molding machine, the speed of retracting load mass 118 is typically less important, as the injection unit (not shown) is typically undergoing recovery during this period.

A manifold 128, including one or more hydraulic valve or valves 130, distributes fluid pressure generated by pump 102 to and from both cylinder side 124 or rod side 126. Although FIG. 3 illustrates a proportional 4-port valve for hydraulic valve 130, those of skill in the art will recognize that the implementation of hydraulic valve 130 is not particularly limited and other types of valves could be used. Fluid drained from either cylinder side 124 or rod side 126 is typically returned to reservoir 106. A variable throttle 132 is provided to adjust the rate of draining hydraulic fluid to reservoir 106. Alternatively, manifold 128 could include regenerative capability, allowing hydraulic fluid to be transferred from the rod side 126 to the bore side 124 of the mold stroke actuator 36, in addition to returning hydraulic fluid directly to reservoir 106.

At a general level, to extend piston 116, cylinder side 124 is pressurized and rod side 126 is depressurized, and to retract piston 116, rod side 126 is pressurized and cylinder side 124 is depressurized. However, in practice, the actuation of mold stroke actuator 36 can be considerably more complex. For example in order to increase acceleration in piston 116, the rate of pumping of hydraulic fluid by motor 104 and pump 102 can be increased to increase the rate of pressurizing of cylinder side 124, or the rate of depressurizing rod side 126 can be increased, or a combination therebetween. Regenerative fluid circuits can also be used to increase performance.

Controller 122 typically stores the velocity profile 82 of mold stroke actuator 36, in order to determine the rate of acceleration/deceleration of piston 116. That is to say, controller 122 either stores or calculates the velocity of load mass 118 at regular points of travel between its fully open and closed positions. Controller 122 is operable to receive tuning parameters 136 from either an operator (via HMI 28) or sensors (not shown) within the molding system 20 in order to achieve the velocities set by the velocity profile 82. Tuning parameters 136 can include such parameters as the mass of load mass 118, friction within the system, and other variances which could adversely affect performance. If controller 122 uses closed loop control, then it also includes the necessary PID controller or controllers.

Normally the goal is to minimize cycle time, by rapidly accelerating and decelerating load mass 118 without causing the machine to jerk excessively. One of the major challenges for this system is the acceleration and deceleration control. The usual, prior art way to control acceleration and deceleration of load mass 118 is to make the speed of pump 102 follow the velocity profile 82 and use valves 130 to build resistance pressure on rod side 126 to slow it down using either open-loop or closed-loop control.

The inventors have determined that this control method has several drawbacks. It needs more than one set of tuning parameters 136 over the full range of movement of mold stroke actuator 36, and compromises on speed and pressure control. When load mass 118 is moving at a high velocity, it can be difficult to lower down meter-in side pressure without causing oscillations in the system. There are two main reasons for the ineffectiveness. The first one is that the response time of valves 130 is usually slower than the response time of pump 102. The second reason is that valve 130 has to build higher pressure on rod side 126 than on cylinder side 124 to slow load mass 118 down. At high speed, this may lead to very high pressures on both sides of cylinder 114. When deceleration starts, the pressure on meter-in side (i.e., usually cylinder side 124) is usually high because of the previously required acceleration force. Pressure will be high on both cylinder side 124 and rod side 126, which can cause oscillation with valve regulation. It is also difficult to lower down meter-in side pressure without causing oscillations.

A method of controlling acceleration and deceleration in a hydraulic actuator operable to vary the amount of hydraulic fluid metered in and metered-out. Pressure on one side of the cylinder is maintained while modulating the pressure on the other. For example, for deceleration/acceleration, the current pressure in the meter-out side of the hydraulic actuator is maintained while the current pressure in the meter-in side of the hydraulic actuator is decreased/increased, respectively. The method may also comprise controlling the pressure on both sides—for example decreasing pressure on the meter-in side of the hydraulic actuator at a higher rate than on the meter-out side of the hydraulic actuator in order to decelerate.

The method for controlling acceleration and deceleration achieves effective control by stabilizing meter-out side pressure and regulating the speed of pump 102. For example, for deceleration, rather than increasing meter-out side pressure across valve 130, the meter-out side is held constant and the meter-in pressure is decreased by adjusting pump 102. Alternately, the current pressure in the meter-out side of the hydraulic actuator may even be decreased, while the current pressure on the meter-in side of the hydraulic actuator is decreased at an even higher rate in order to achieve the desired motion profile.

By adjusting meter-in side pressure at a higher rate than meter-out side pressure, more accurate speed and pressure control is achieved. Valve 130 and variable throttle 132 do not need to react as quickly as in prior art control methods in regulating pressure on both sides of mold stroke actuator 36. Additionally, pump 102 reacts more quickly to achieve the velocity profile, thereby regulating pressure on the meter-in side.

In normal operation mold stroke actuator 36 is actuated at high speed over a distance (x) to reduce travel time (t). The meter-in side pressure (cylinder side 124 when extending piston 116) is usually high when the deceleration starts. Controller 122 attempts to slow down load mass 118 smoothly while lowering down the meter-in side pressure. To match the velocity of load mass 118 with a velocity profile 82, hydraulic forces are produced in hydraulic actuator 112 in order to provide the required acceleration or deceleration and overcome friction. These forces can be represented as follows:

$$M \cdot \frac{\partial^2 x}{\partial t^2} = P_a \cdot A_a - P_a \cdot A_b - F_r \tag{1}$$

where

M is the mass of load mass 118

$P_a$ and $P_b$ are the pressure values supplied to cylinder side 124 and rod side 126 respectively $A_a$ and $A_b$ are the cross-sectional areas of the cylinder side 124 and rod side 126, respectively $F_r$ is the friction arising from both the load mass 118 and the cylinder seals in mold stroke actuator 36.

There are many pressure setpoints for the meter-in and meter-out sides that will satisfy equation (1) and thereby produce the desired velocity profile 82 for of load mass 118.

The oil volume that must be supplied for cylinder pressurization during actuation of mold stroke actuator 36 is increased, both due to the larger fluid volume as well as the deformation of the hoses. The incremental oil volume ($\Delta V_{oil}$) that must be added to create an incremental pressure change ($\Delta P$) is derived using the bulk modulus ($\beta$) of the constituents:

$$\Delta V_{oil} = \Delta P \cdot \left(\frac{V_{hose}}{\beta_{hose}} + \frac{V_{Oil}}{\beta_{Oil}}\right) \tag{2}$$

The oil flow (Q) required on either the cylinder side 124 ($Q_a$) or rod side 126 ($Q_b$) of the hydraulic actuator 112 is the sum of the flow required for the instantaneous load speed and that required for pressure change:

$$Q_a = A_a \cdot \frac{\partial x}{\partial t} + \frac{\partial P_a}{\partial t} \cdot \left(\frac{V_{HoseA}}{\beta_{HoseA}} + \frac{V_{OilA}}{\beta_{OilA}}\right) \tag{3}$$

$$Q_b = A_b \cdot \frac{\partial x}{\partial t} - \frac{\partial P_b}{\partial t} \cdot \left(\frac{V_{HoseB}}{\beta_{HoseB}} + \frac{V_{OilB}}{\beta_{OilB}}\right) \tag{4}$$

The supply oil flow is given by the rotational speed and volume displacement of pump 102, $f_{pump}$ and $V_{pump}$, respectively. The return oil flow and pressure are related by the characteristic of the variable throttle 132, which relates flow to pressure drop and valve command v(volts):

$$Q_a = V_{pump} \cdot f_{pump} \tag{5}$$

$$Q_b = q(v) \cdot \sqrt{\frac{P_b}{P_{nom}}} \tag{6}$$

The nominal flow function (q) gives the flow as a function of command at a nominal pressure drop $P_{nom}$, normally 0.5 or 1 MPa.

The above paragraphs analyze the load dynamics in a general way. In practice, the physical parameters of hydraulic system 100 may not be precisely known—these parameters include the friction, load mass, and system compressibility. Nevertheless, application of this approach can still improve the control behavior. The analysis allows us to define pressure setpoints on the two sides of the hydraulic actuator 112 that also satisfy equation (1).

According to one implementation of the method, constant pressure is applied to the meter-out side (i.e., normally the rod side 126 during mold close). If the meter-out side pressure is constant, differentiating equation (1) with respect to time (t), and assuming return side pressure and friction are constant, yields:

$$\frac{\partial P_a}{\partial t} = \frac{M}{A_a} \cdot J \tag{7}$$

$$J = \frac{\partial^3 x}{\partial t^3} \tag{8}$$

These equations relate the required rate of pressure change to the jerk (J), which is the third derivative of the load position, or rate of change of load acceleration.

For acceleration, the pressure setpoint for the meter-out side is constrained by the valve design and the speed reached after acceleration. For deceleration, the pressure setpoint for the meter-out side is calculated as the sum of a minimum meter-in pressure and the required maximum deceleration pressure. The minimum meter-in pressure is that required to avoid vacuum on the meter-in side of the cylinder.

$$P_{amin} = P_b \cdot \frac{A_b}{A_a} + \frac{M a_{dec\text{-}max}}{A_a} \tag{9}$$

The above equation gives the constant pressure $P_b$ on the meter out side. The variable pressure $P_a$ at any point in time is:

$$P_a = P_{amin} + \frac{M(a_{dec\text{-}max} - a_{dec})}{A_a} \tag{10}$$

The flow setpoint on the meter-out side ($L_b$), since the pressure is constant, is the speed setpoint ($V_{SP}$) multiplied by the cylinder area ($A_b$) of the hydraulic actuator 36 on the meter-out side.

$$L_b = V_{SP} \cdot A_b \tag{11}$$

With constant pressure on the return side ($P_b$), the throttle valve command for variable throttle 132 is given from the solution of:

$$q(v) = L_b \cdot \sqrt{\frac{P_b}{P_{NOM}}} \tag{12}$$

The speed of pump 102 can be calculated in two ways: open-loop control and closed-loop control. In the open-loop case, the speed of pump 102 is calculated from the velocity profile plus jerk compensation. The required velocity profile for motor 104 is then given in terms of the desired load velocity V and jerk J:

$$f_{pump} = \frac{1}{V_{pump}}\left(A_a \cdot V_{SP} + \frac{M}{A_a} J_{SP} \cdot \left(\frac{V_{HoseA}}{\beta_{HoseA}} + \frac{V_{OilA}}{\beta_{OilA}}\right)\right) \tag{13}$$

In the closed-loop case, the speed of pump 102 is calculated from the deceleration velocity profile with jerk compensation plus the contribution from the PID controller for velocity profile 82.

$$f_{pump} = \frac{1}{V_{pump}}\left(A_a \cdot V_{SP} + \frac{M}{A} \cdot J_{SP} \cdot \left(\frac{V_{HoseA}}{\beta_{HoseA}} + \frac{V_{OilA}}{\beta_{OilA}}\right) + PID(V_{SP}, V_{PV})\right) \tag{14}$$

In practice, the new control method allows mold stroke actuator 36 to smoothly follow its velocity profile 82, and come to an accurate and smooth stop. Because the actual speed of mold stroke actuator 36 follows the velocity profile 82 very closely, the safety distance, which is usually reserved to handle the speed lagging, can be reduced, saving more travel time. The closed-loop control gives better results in handling the model errors. In addition, with the pump speed control, the meter-in side pressure is significantly reduced during deceleration. This gives extra benefits for mold protection in some cases.

While the present invention has been described with respect to what is presently considered to be the non-limiting embodiments, it is to be understood that the invention is not limited to the disclosed embodiments described above. To the contrary, the present invention is intended to cover various modifications and equivalent arrangements included within the scope of the appended claims. The scope of the following claims is to be accorded the broadest interpretation so as to encompass all such modifications and equivalent structures and functions.

What is claimed is:

1. A method for decelerating a hydraulic actuator, the method comprising:

performing one of maintaining pressure and decreasing the pressure in a meter-out side of the hydraulic actuator;

decreasing pressure on a meter-in side of the hydraulic actuator, the hydraulic actuator decreasing pressure on the meter-in side more rapidly than on the meter-out side of the hydraulic actuator; and wherein decreasing the pressure on the meter-in side of the hydraulic actuator is achieved by adjusting a speed in a pump.

2. The method of claim 1, wherein a pressure setpoint on the meter-out side of the hydraulic actuator is calculated as a sum of a minimum meter-in pressure and a required maximum deceleration pressure.

3. The method of claim 2, wherein the minimum meter-in pressure on the meter-in side of the hydraulic actuator is calculated to avoid a vacuum within the hydraulic actuator during deceleration.

4. The method of claim 3, wherein a flow setpoint on the meter-out side is calculated as a speed setpoint multiplied by a cross-sectional area of the hydraulic actuator on the meter-out side.

5. The method of claim 4, wherein the speed of the pump is regulated by an open-loop control that calculates the speed of the pump from a velocity profile plus jerk compensation.

6. The method of claim 4, wherein the speed of the pump is regulated by a closed-loop control which calculates the speed of the pump from a velocity profile with jerk compensation plus a contribution from a PID controller.

7. A method for accelerating a hydraulic actuator, the method comprising:

performing one of maintaining pressure and increasing the pressure in a meter-out side of the hydraulic actuator;

increasing pressure on a meter-in side of the hydraulic actuator, the hydraulic actuator increasing pressure on the meter-in side more rapidly than on the meter-out side of the hydraulic actuator; and wherein increasing the pressure on the meter-in side of the hydraulic actuator is achieved by adjusting a speed in a pump.

8. The method of claim 7, wherein a pressure setpoint on the meter-out side of the hydraulic actuator is calculated as a sum of a minimum meter-in pressure and a required maximum acceleration pressure.

9. The method of claim 8, wherein the minimum meter-in pressure on the meter-in side of the hydraulic actuator is calculated to avoid a vacuum within the hydraulic actuator during acceleration.

10. The method of claim 9, wherein a flow setpoint on the meter-out side is calculated as a speed setpoint multiplied by a cross-sectional area of the hydraulic actuator on the meter-out side.

11. The method of claim 10, wherein the speed of the pump is regulated by an open-loop control that calculates the speed of the pump from an velocity profile plus jerk compensation.

12. The method of claim 10, wherein the speed of the pump is regulated by a closed-loop control which calculates the speed of the pump from a velocity profile with jerk compensation plus a contribution from a PID controller.

13. A hydraulic system, comprising:

a pump, operably connected to a motor;

a hydraulic actuator, operably connected to the pump;

a hydraulic valve, operable to direct hydraulic fluid to and from either a rod side or a cylinder side of the hydraulic actuator; and a controller, configured to alternatively accelerate and decelerate the hydraulic actuator by:

performing one of maintaining a current pressure and adjusting the pressure in a meter-out side of the hydraulic actuator;

adjusting pressure on a meter-in side of the hydraulic actuator at a higher rate than on the meter-out side of the hydraulic actuator; and wherein adjusting the pressure on the meter-in side of the hydraulic actuator is achieved by adjusting a speed in the pump.

14. The hydraulic system of claim 13, wherein the controller is operable to control acceleration by increasing the speed of the pump so that the pressure on the meter-in side is greater than on the meter-out side of the hydraulic actuator.

15. The hydraulic system of claim 14, wherein the controller is operable to control deceleration by decreasing the speed of the pump so that the pressure on the meter-in side is less than on the meter-out side of the hydraulic actuator.

16. The hydraulic system of claim 15, wherein a pressure setpoint on the meter-out side of the hydraulic actuator is calculated by the controller as a sum of a minimum meter-in pressure and a required maximum deceleration pressure.

17. The hydraulic system of claim 16, wherein the pressure setpoint on the meter-in side of the hydraulic actuator is greater that that required to avoid a vacuum within the hydraulic actuator during deceleration.

18. The hydraulic system of claim 17, wherein a flow setpoint on the meter-out side is calculated by the controller as a speed setpoint multiplied by a cross-sectional area of the hydraulic actuator on the meter-out side.

19. The hydraulic system of claim 18, wherein the speed of the pump is regulated by an open-loop control that calculates the speed of the pump from a velocity profile plus jerk compensation.

20. The hydraulic system of claim 18, wherein the speed of the pump is regulated by a closed-loop control which calculates the speed of the pump from a velocity profile with jerk compensation plus a contribution from a PID controller.

* * * * *